US009863382B2

(12) United States Patent
Xu et al.

(10) Patent No.: US 9,863,382 B2
(45) Date of Patent: Jan. 9, 2018

(54) HIGH PRESSURE OIL PUMP ROLLER TAPPET

(71) Applicant: Hangzhou XZB Tech Co.,Ltd, Hangzhou (CN)

(72) Inventors: Na Xu, Hangzhou (CN); Haijun Ren, Hangzhou (CN)

(73) Assignee: Hangzhou XZB Tech Co., Ltd, Hangzhou (CN)

( * ) Notice: Subject to any disclaimer, the term of this patent is extended or adjusted under 35 U.S.C. 154(b) by 97 days.

(21) Appl. No.: 15/191,543

(22) Filed: Jun. 24, 2016

(65) Prior Publication Data

US 2017/0342951 A1 Nov. 30, 2017

(30) Foreign Application Priority Data

May 25, 2016 (CN) ..... 2016 1 0351534
May 25, 2016 (CN) ..... 2016 2 0486009 U

(51) Int. Cl.

| | |
|---|---|
| ***F01L 1/14*** | (2006.01) |
| ***F02M 59/10*** | (2006.01) |
| ***F01L 1/46*** | (2006.01) |
| *F01L 1/245* | (2006.01) |

(52) U.S. Cl.

CPC ..... *F02M 59/102* (2013.01); *F01L 1/46* (2013.01); *F01L 1/14* (2013.01); *F01L 1/245* (2013.01); *F01L 2105/00* (2013.01); *F01L 2105/02* (2013.01); *F01L 2109/00* (2013.01)

(58) Field of Classification Search

CPC ..... F01L 1/14; F01L 1/245; F01L 1/46; F01L 2105/02; F01L 2107/00

USPC ..... 123/90.48

See application file for complete search history.

(56) References Cited

U.S. PATENT DOCUMENTS

| | | | | |
|---|---|---|---|---|
| 3,628,514 | A | 12/1971 | Phillips | |
| 4,549,509 | A | 10/1985 | Burtchell | |
| 6,405,698 | B1 | 6/2002 | Steinmetz | |
| 6,688,269 | B1 | 2/2004 | Steinmetz | |
| 8,104,442 | B2 | 1/2012 | Dorn et al. | |
| 8,800,519 | B2 | 8/2014 | Dorn et al. | |
| 2008/0190237 | A1 * | 8/2008 | Radinger | F01L 1/143 74/569 |
| 2010/0037865 | A1 | 2/2010 | Fuchs | |
| 2012/0234277 | A1 | 9/2012 | Dorn et al. | |
| 2012/0294741 | A1 | 11/2012 | Nishimura | |
| 2015/0285104 | A1 | 10/2015 | Sailer et al. | |
| 2016/0084116 | A1 | 3/2016 | Ludwig et al. | |

* cited by examiner

*Primary Examiner* — Jorge Leon, Jr.
(74) *Attorney, Agent, or Firm* — Gokalp Bayramoglu

(57) ABSTRACT

A high-pressure oil pump roller tappet, used for automobile fuel injection system, mounted between the driving cam and the tappet. The roller tappet includes a shell, a holder, a roller, and a pin. Planes A are arranged on both sides of the seam on lateral sides of the shell. Holes I are arranged at symmetrical positions on two planes A. Holes II are arranged on symmetrical positions on vertical plates. The roller is located in the middle of the pin. Welding has no requirement on the thickness of the plate. The weight can be controlled effectively, reducing inertia force, friction, and wear, improving engine efficiency. The shell and holder are designed as being separate, ensuring that the shell subjects to lateral force as little as possible when the holder subjects to a force, such that the shell is less likely to vibrate. Thus, the shell avoids the abrasion.

9 Claims, 16 Drawing Sheets

HIGH PRESSURE OIL PUMP ROLLER TAPPET

TECHNICAL FIELD

The invention relates to the technical field of engine equipment, especially to a high pressure oil pump roller tappet.

BACKGROUND

The roller tappet is an important part of the automobile engine using high-pressure oil pump system, and is mounted between the driving cam and the tappet to transform the rotational motion of the driving cam into the linear reciprocating motion of the tappet. The main structure of the roller tappet includes a shell, a holder, a roller and a pin.

The existing shell of the high pressure oil pump roller tappet is made by integrated forging process, which is complex and costly, and has a certain requirement on the thickness of the plate during stamping. As a result, it is difficult to reduce weight and the cost. The shell may be forged integrally with the holder. Alternatively, the holder may be directly arranged on the shell. As a result, the lateral force acting on the holder from the driving cam will be transmitted to the shell, causing the vibration of the shell inside the cylinder. Accordingly, damages to the cylinder and the shell are likely to be caused. The bottom of the holder is a plane. When the holder vibrates, there will be partial wearing of tappet which contacts the holder. In order to limited to the axial motion of the roller tappet, it is necessary to embed locking blocks in the lateral side of the shell. The locking block is a separate structure from the shell. Its manufacture process is complex.

SUMMARY OF THE INVENTION

The invention is to solve the technical problem above, and provide a high-pressure oil pump roller tappet. Its structure and assembly process are easy. The number of parts is reduced. The cost and weight are lowered. Unnecessary friction between respective parts is cut down. The reliability is improved.

To achieve the above purposes, technical solutions used by the invention are as follows:

A high-pressure oil pump roller tappet, which is used for an automobile fuel injection system, is mounted between a driving cam and a tappet. The roller tappet includes a shell, a holder, a roller, and a pin. The shell whose main structure is a cylindrical housing is made by bending a steel plate in a surrounding way. First plane that are in parallel and symmetrical with each other are arranged on both sides of a seam on lateral sides of the shell. First holes are arranged at symmetrical positions on the two first planes. The holder is of a U-shape. Second holes are arranged on symmetrical positions on vertical plates. The roller is located in the middle of the pin. Two ends of the pin pass through the first holes and the second holes respectively. The presence of the seam can provide a small deformable margin, making the shell to be assembled in an external cylinder more suitably. After assembly, the roller presses against the driving cam, and the holder presses against the tappet. The first hole of the shell is of a clearance fit with the pin. The hole of the holder is of the interference fit with the pin. The rotational motion of the driving cam is transformed into the linear reciprocating motion of the tappet, pushing the tappet to move at the same time. The holder is connected with the shell in series by the pin, while the shell is of a clearance fit with the pin. Thus, the holder is relatively independent from the shell. When the holder swings, the shell will not be shaken. At the same time, the holder is of an interference fit with the pin, making the force of the driving cam transmit to the tappet efficiently.

Preferably, the steel plates on both ends of the seam are pre-stamped to form inward recesses, and welding spots 1.3 are provide therein, which can effectively reduce the strain generated by welding.

Preferably, a locking block is arranged on the seam between the welding spots or the seam on the shell 1 opposing the seam. The locking block is a sector cylinder made by stamping, which protrudes from the shell. The locking block can be a short locking block or a long locking block. The function of the locking block is to limit the axial rotation of the shell inside the cylinder. The length of the locking block can be adjusted between the two welding spots to fit sizes of different oil pump cylinders.

Preferably, all of the lateral planes of the shell 1 on which the first planes are located are of planar structure, which is easy to manufacture and assemble.

Preferably, when all of the lateral planes of the shell on which the first planes are located are of planar structure, the weight can be reduced by punching holes in the first planes.

Preferably, the lower portion of the lateral plane of the shell on which the first plane is located is of a cylindrical structure, making the shell match the external cylinder better.

Preferably, the first plane is stamped inwardly, and thereby a bayonet 1.6 is formed between the plane and the lower portion of the cylindrical structure. The vertical plates of the holder can pass through the bayonet. After assembly, the two vertical plates of the holder are located outside the first plane. The force distribution on the pin can be improved in working.

Preferably, the baseplate of the holder can be a first baseplate with a projecting curved surface structure or a second baseplate with a planar structure. The contact portion of the first baseplate and the tappet is a line, which efficiently reduces the friction loss between them. The contact portion of the second baseplate and the tappet is a plane. Though the friction loss is more than that of the baseplate, materials are saved and the producing process is simpler.

Preferably, a groove is arranged on the underside of the baseplate of the holder. A boss is formed on the upper side of the baseplate of the holder accordingly. The groove and the boss are formed by stamping on the baseplate. The groove and the tappet can form a simple nesting relationship, making the transmission efficiency there between higher.

Preferably, several ribs are arranged on bending parts between the vertical plates and the baseplate of the holder. The ribs are formed by stamping. The stiffness and the impact toughness of the holder can be significantly strengthened by the ribs.

Preferably, the roller can be selected as the bearing with or without a cage.

Preferably, both ends of the pin can be the second plane or the curved surface. The curvature of the curved surface is the same as that of the shell. The pin with the planar structure is easy to process. The pin with the curved structure does not need riveting and positioning on the shell after assembly. The curved surface of both ends can match the oil pump cylinder well. The installation and positioning are simple.

Advantageous effects of the invention lie in that:

1. The shell structure is designed integrally. After bending, the plate is welded into a cylinder. The structure and the assembly process are easy. The number of parts is reduced. Welding has no requirement on the thickness of the plate. It can be selected freely choose from 0.5 to 1.5 mm in accordance with the requirement of cost control. Thus, the cost and weight can be controlled effectively. The inertia force is lowered. The friction and loss are reduced. The efficiency and the reliability of engine are improved.

2. The shell and the holder are designed as separate, ensuring that the shell subjects to lateral force as little as possible when the holder subjects to a force. Such that the shell is unlikely to vibrate. Thus, the shell avoids abrasion.

3. The bottom of the holder can be designed as an arched surface, making the surface contact between the holder and the tappet become the regional contact, such that the friction is reduced effectively.

4. The locking block used to limit the axial rotation of the roller tappet is designed as integral with the shell. The efficiency can be increased efficiently. The cost is reduced.

5. The holder is of a U-shaped structure. It can reduce the mass, and improve the stiffness at the same time.

6. The pin is in an interference fit with the holder, and in a clearance fit with the shell. Thus, it can transmit the force from the driving cam effectively, and reduce the lateral force on the shell.

1 shell; 1.1 first hole; 1.2 first plane; 1.3 welding spot; 1.4 seam; 1.5 short locking block; 1.6 bayonet; 1.7 long locking block; 2 holder; 2.1 second hole; 2.2 first baseplate; 2.3 second baseplate; 2.4 groove; 2.5 boss; 2.6 rib; 3 roller; 4 pin; 4.1 second plane; 4.2 curved surface; 5 driving cam; 6 tappet.

DETAILED DESCRIPTION

Figure 1:
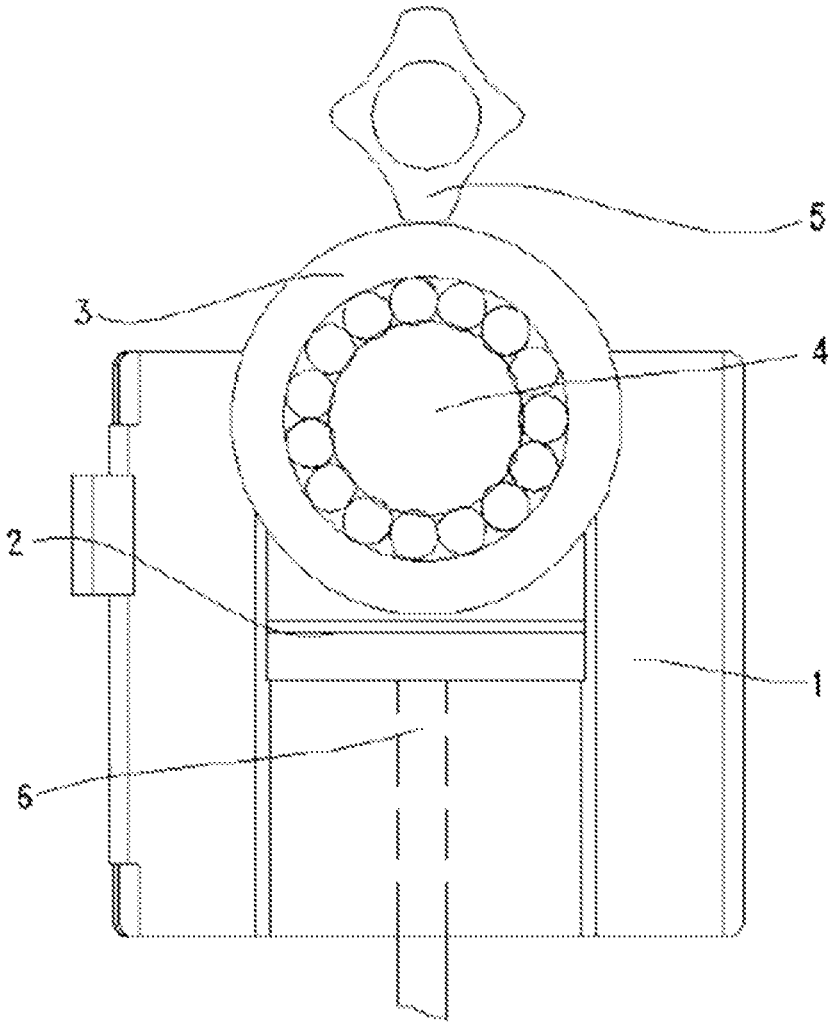
FIG. 1 is a schematic diagram of the operation of the invention.
Figure 2:
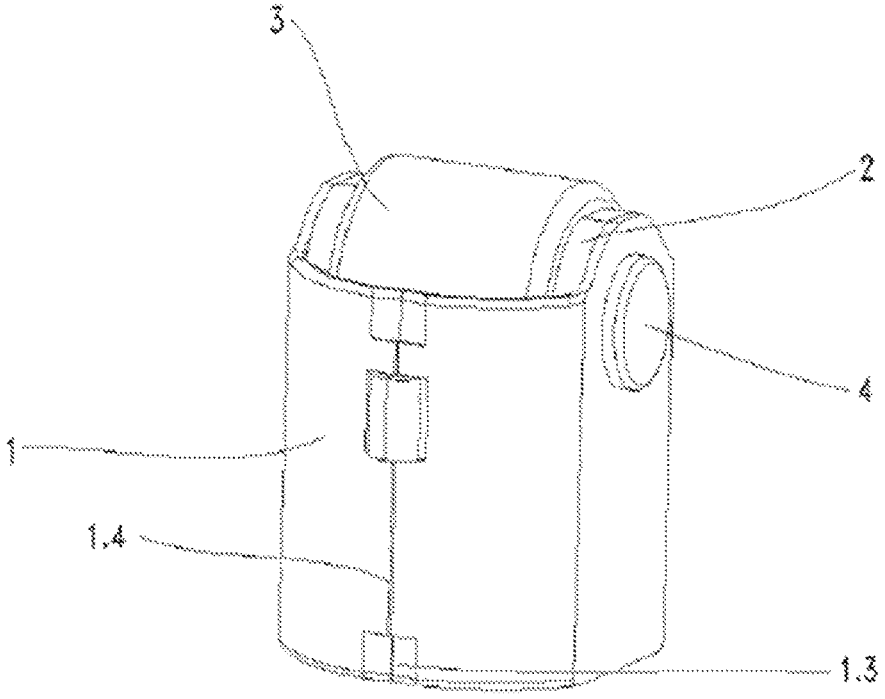
FIG. 2 is an assembly drawing of one embodiment of the invention.
Figure 3:
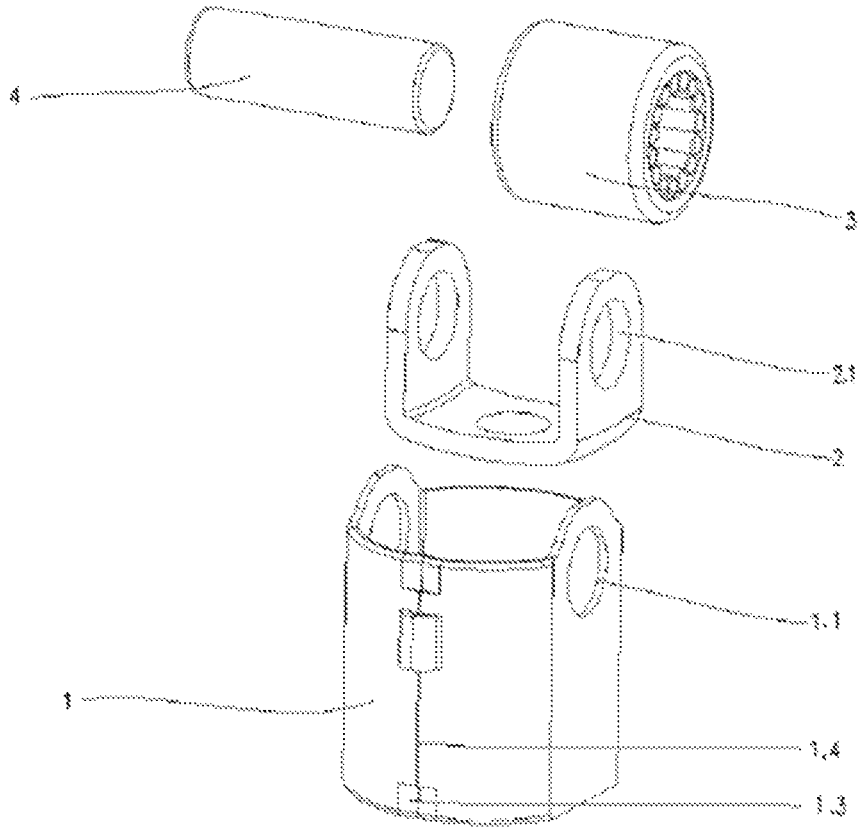
FIG. 3 is an explosive view of FIG. 2.

The present invention is further illustrated by embodiments and drawings hereinafter:

The embodiment is: as shown in FIGS. 1 to 3, a high-pressure oil pump roller tappet, which is used for an automobile fuel injection system, is mounted between a driving cam 5 and a tappet 6. The roller tappet includes a shell 1, a holder 2, a roller 3, and a pin 4. The shell 1 whose main structure is a cylindrical housing is made by bending a steel plate in a surrounding way. First planes 1.2 that are in parallel and symmetrical with each other are arranged on both sides of a seam 1.4 on lateral sides of the shell. First holes 1.1 are arranged at symmetrical positions on the two planes 1.2. The holder 2 is of a U-shaped. Second holes 2.1 are arranged at symmetrical positions on vertical plates. The roller 3 is located in the middle of the pin 4. Two ends of the pin 4 pass through the first holes 1.1 and the second holes 2.1 respectively.

The steel plates on both ends of the seam 1.4 are pre-stamped to form inward recesses, and welding spots 1.3 are provided therein. A locking block is arranged on the seam 1.4 between the welding spots 1.3 or on the shell 1 opposing the seam 1.4. The locking block is a sector cylinder made by stamping, which protrudes from the shell. The length of the locking block can be adjusted between the two welding spots to fit sizes of different oil pump cylinders.

In the embodiment of the invention, the shell 1, the holder 2, and the pin 4 have many different variations.

Among them, variations of the shell 1 include:

Embodiment 1

Figure 4:
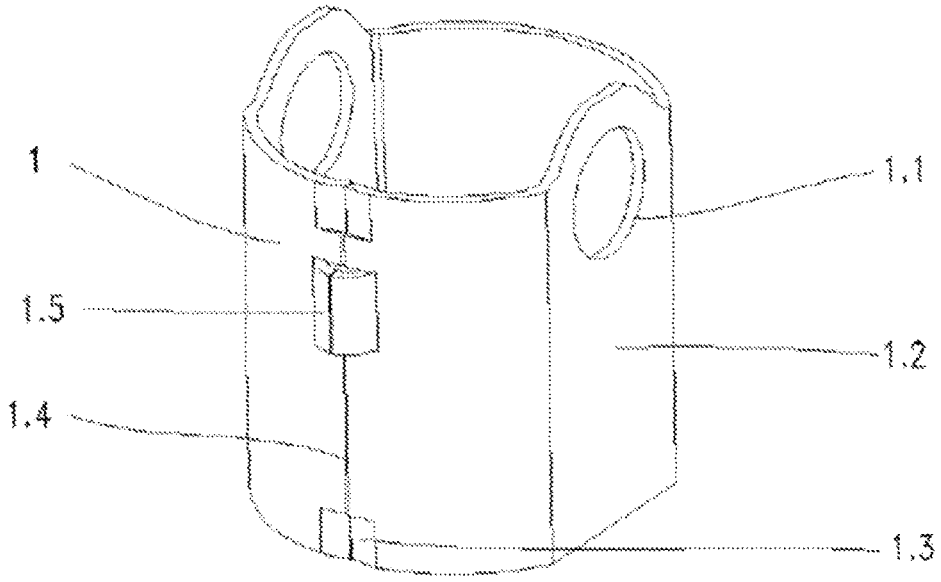
FIG. 4 is a schematically structural diagram of Embodiment 1 of the housing of the invention.

As shown in FIG. 4, all of the lateral planes of the shell 1 on which the planes 1.2 located are of the planar structure. The locking block is a short locking block 1.5.

Embodiment 2

Figure 5:
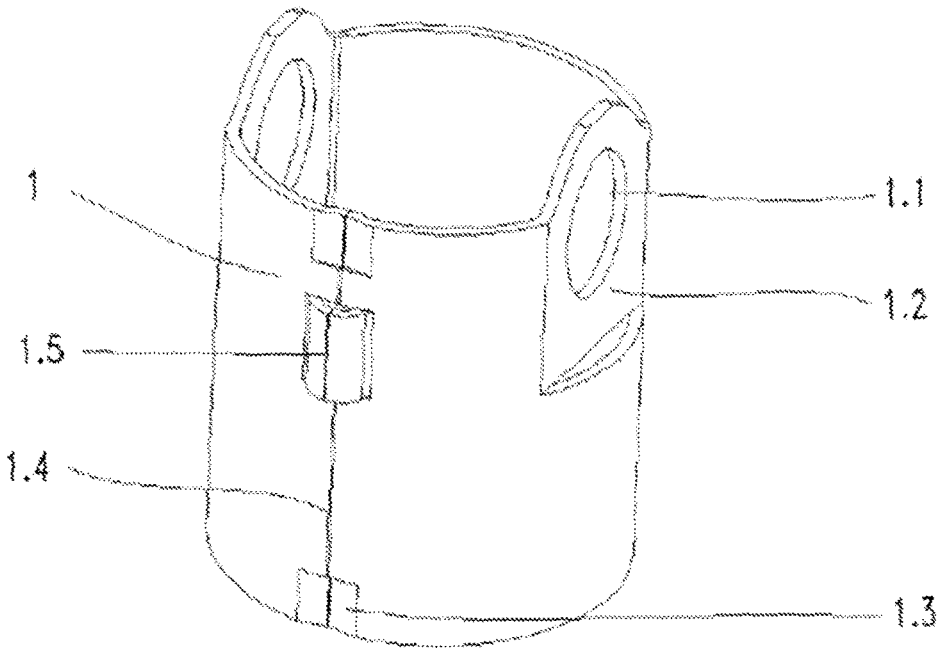
FIG. 5 is a schematically structural diagram of Embodiment 2 of the housing of the invention.

As shown in FIG. 5, the lower portion of the lateral plane of the shell 1 on which the first plane 1.2 is located is a cylindrical structure. The locking block is the short locking block 1.5.

Embodiment 3

Figure 6:
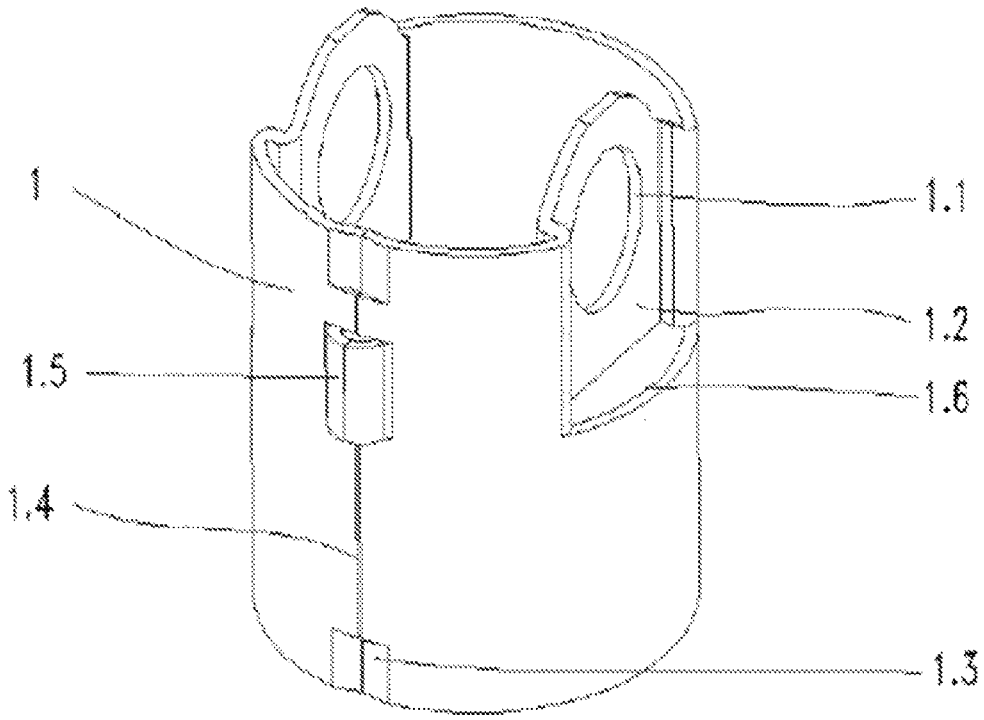
FIG. 6 is a schematically structural diagram of Embodiment 3 of the housing of the invention.

As shown in FIG. 6, the lower portion of the lateral plane of the shell 1 on which the plane 1.2 is located is of the cylindrical structure. The first plane 1.2 is stamped inwardly, and thereby a bayonet 1.6 is formed between the first plane 1.2 and the lower portion of the cylindrical structure. The vertical plates of the holder 2 can pass through the bayonet 1.6. The locking block is the short locking block 1.5.

Embodiment 4

Figure 7:
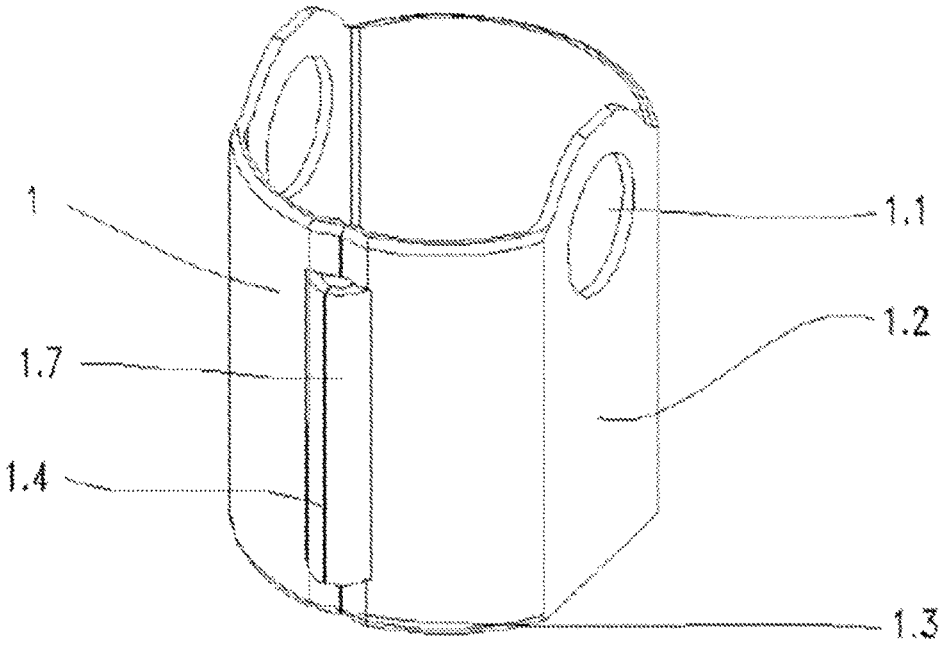
FIG. 7 is a schematically structural diagram of Embodiment 4 of the housing of the invention.

As shown in FIG. 7, the lateral planes on the shell 1 on which the planes 1.2 are located are all of the planar structure. The difference with respect to Embodiment 1 is that the locking block is a long locking block 1.7.

Obviously, the structure of the long locking block 1.7 in Embodiment 4 of the shell 1.7 can also be applied to Embodiment 2 and Embodiment 3

Moreover, in Embodiment 1 and Embodiment 4 of the shell 1, the weight can be reduced by punching holes in the first plane 1.2.

Among them, variations of the holder 2 include:

Embodiment 1

Figure 8:
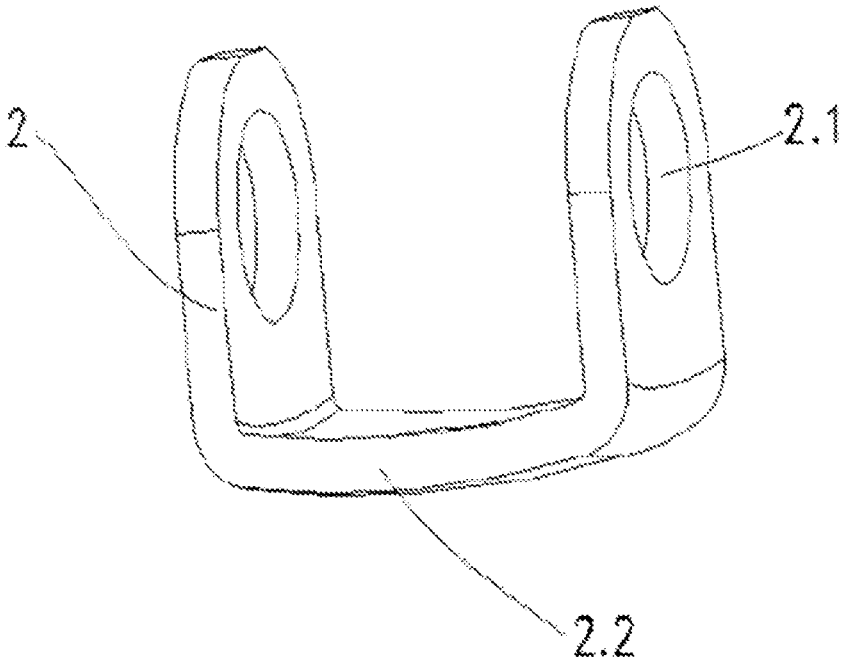
FIG. 8 is the schematically structural diagram of Embodiment 1 of the holder of the invention.

As shown in FIG. 8, the baseplate of the holder 2 is the first baseplate 2.2 which has a projecting curved structure.

Embodiment 2

Figure 9:
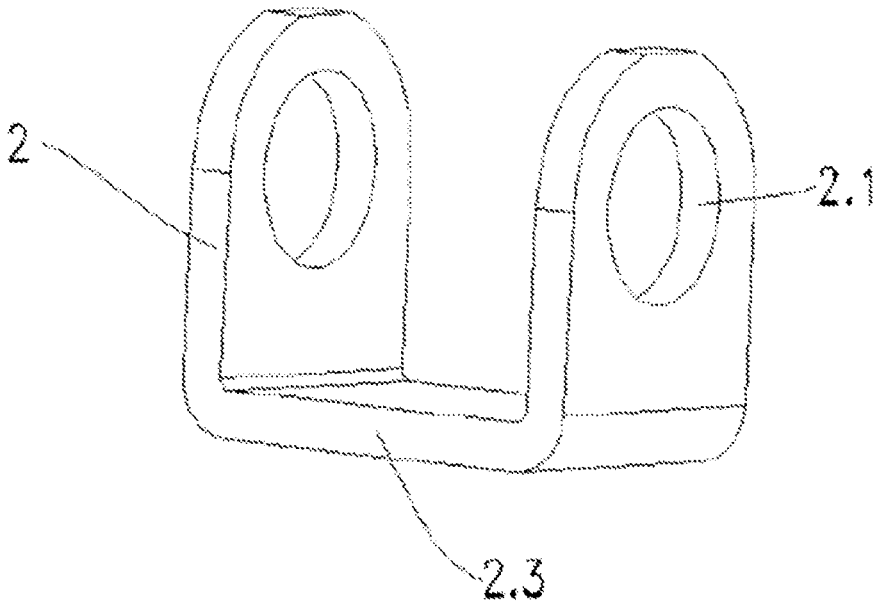
FIG. 9 is a schematically structural diagram of Embodiment 2 of the holder of the invention.

As shown in FIG. 9, the baseplate of the holder 2 is the second baseplate 2.3 which has a planar structure.

Embodiment 3

Figure 10:
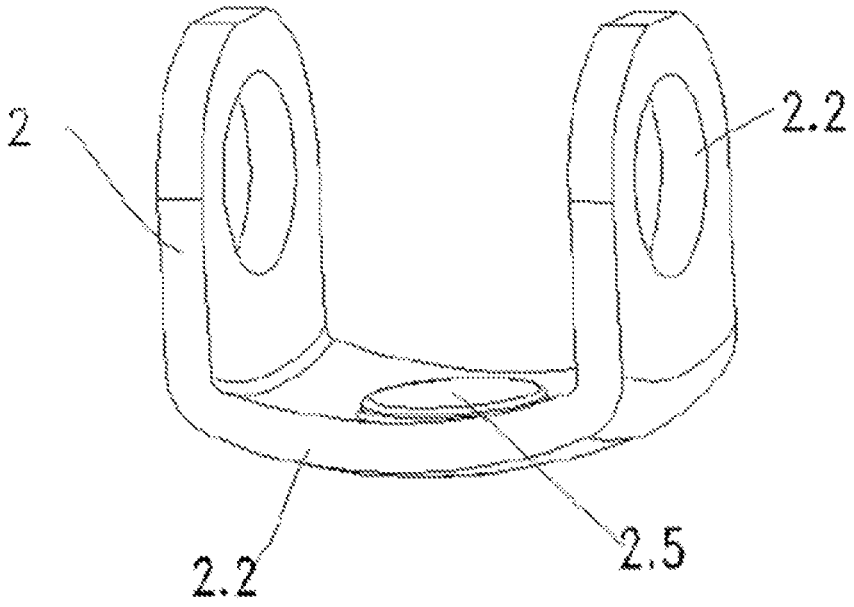
FIG. 10 is a schematically structural diagram of Embodiment 3 of the holder of the invention.
Figure 11:
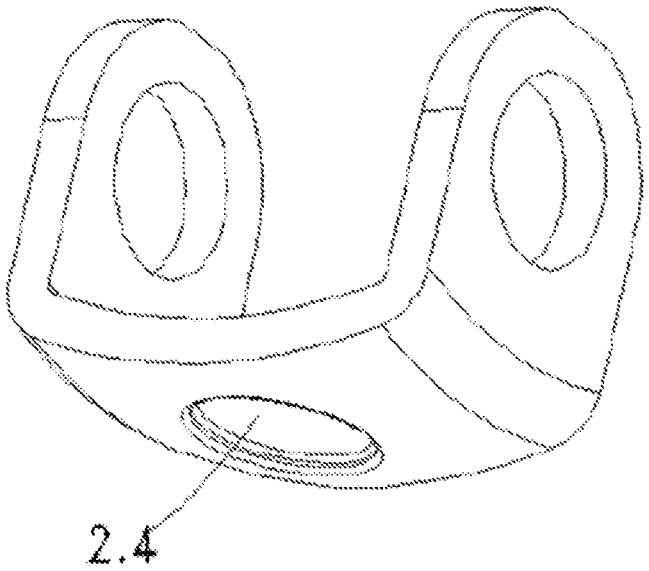
FIG. 11 is a bottom structural view of FIG. 10.

As shown in FIG. 10 and FIG. 11, the baseplate of the holder 2 is the first baseplate 2.2 which has a projecting curved structure. A groove 2.4 is arranged on the underside of the first baseplate 2.2. A boss 2.5 is formed on the upper side of the first baseplate 2.2 accordingly.

Embodiment 4

Figure 12:
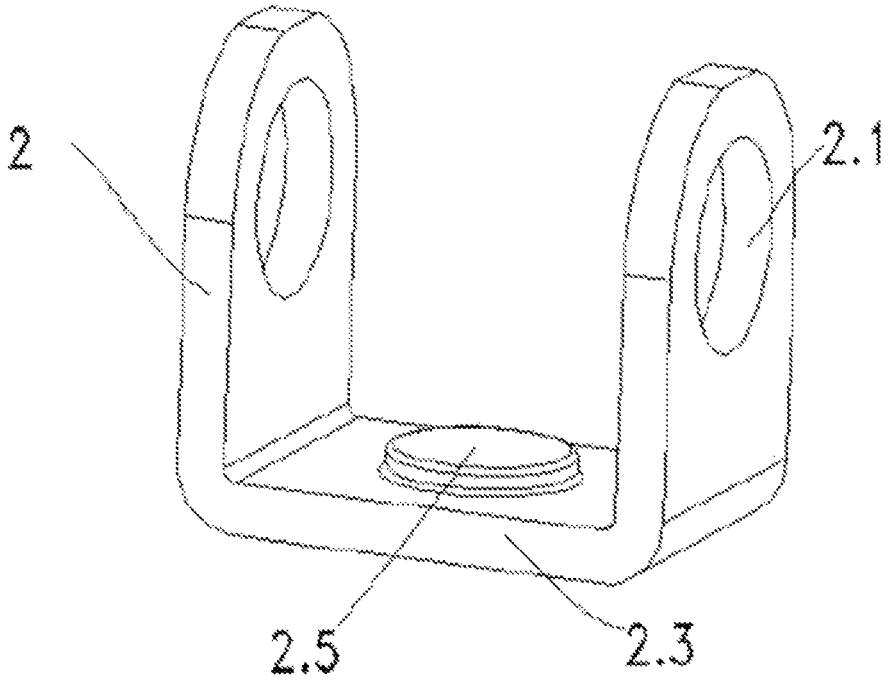
FIG. 12 is a schematically structural diagram of Embodiment 4 of the holder of the invention.
Figure 13:
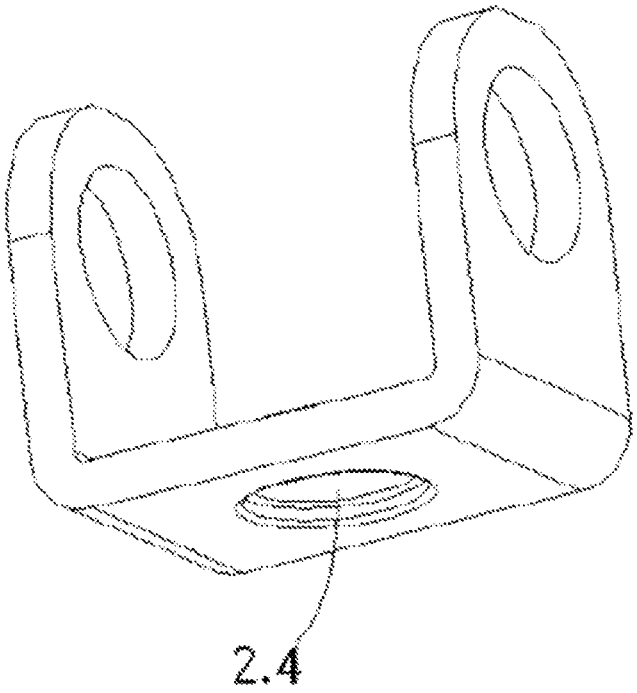
FIG. 13 is the bottom schematically a structural view of FIG. 12.

As shown in FIG. 12 and FIG. 13, the baseplate of the holder 2 is the second baseplate 2.3 which has a planar structure. A groove 2.4 is arranged on the underside of the second baseplate 2.3. A boss 2.5 is formed on the upper side of the second baseplate 2.3 accordingly.

Embodiment 5

Figure 14:
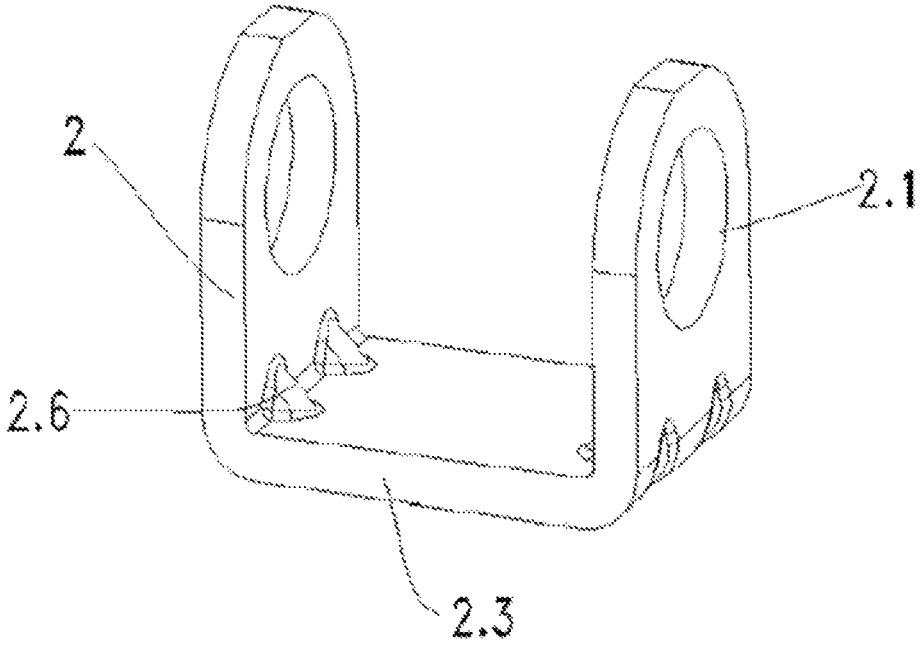
FIG. 14 is the schematically structural diagram of Embodiment 5 of the holder of the invention.

As shown in FIG. 14, the baseplate of the holder 2 is the second baseplate 2.3 which has a planar structure. The difference with respect to Embodiment 2 lies in that a plurality of the ribs 2.6 are arranged on bending parts between the vertical plates and the baseplate of the holder 2.

Obviously, the structure of the rib 2.6 in Embodiment 5 of the holder 2 can also be applied to Embodiment 1, Embodiment 3, and Embodiment 4.

Among them, variations of the pin 4 include:

Embodiment 1

Figure 15:
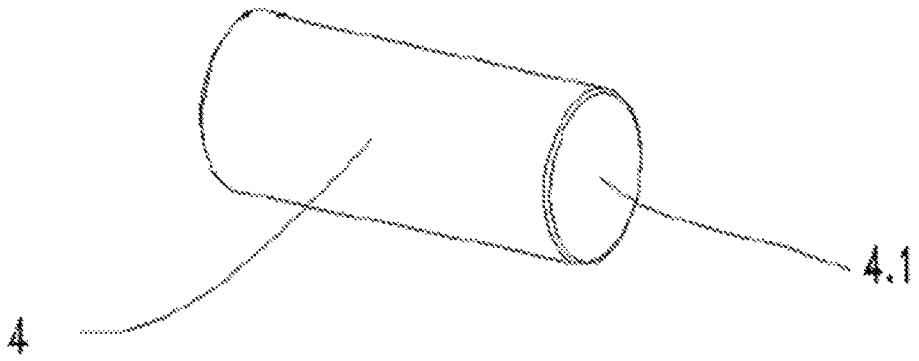
FIG. 15 is the schematically structural diagram of Embodiment 1 of the pin of the invention.

As shown in FIG. 15, both ends of the pin 4 are of second planes 4.1.

Embodiment 2

Figure 16:
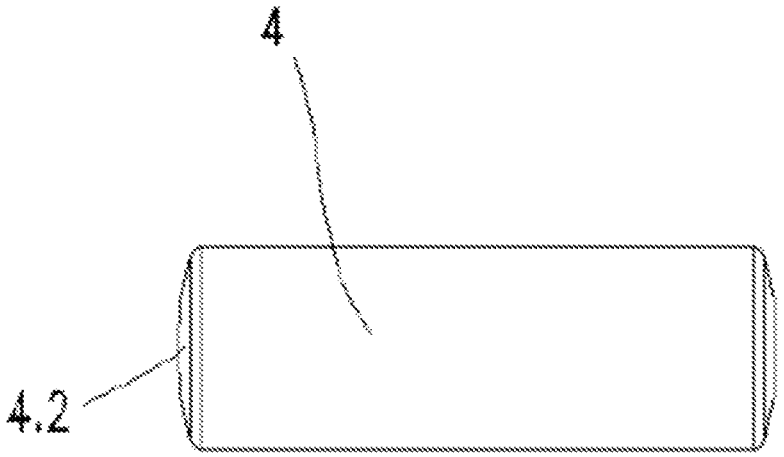
FIG. 16 is the schematically structural diagram of Embodiment 2 of the pin of the invention.

As shown in FIG. 16, both ends of the pin 4 are of curved surfaces 4.2. The curvature of the curved surface 4.2 is the same as that of the shell 1.

Moreover, if necessary, when assembling, various embodiments of the shell 1, the holder 2, and the pin 4 as described above can be combined freely.

The above is only the embodiments of the invention, but the structural features of the invention are not limited thereto. The invention can be used in similar production. Any changes or modifications made by a person with ordinary skill in this art that fall in the field of the invention, are within the patent scope of the invention.

The invention claimed is:

1. A high-pressure oil pump roller tappet, used in an automobile fuel injection system, mounted between a driving cam and a tappet, wherein: the roller tappet comprises a shell, a holder, a roller, and a pin; wherein the shell whose main structure is a cylindrical housing is made by bending a steel plate; wherein at least two first planes are in parallel and symmetrical with each other and are arranged on both sides of a seam on a plurality of lateral sides of the shell; wherein at least two first holes are arranged at symmetrical positions on the at least two first planes, wherein the holder is of a U-shape, at least two second holes are arranged at symmetrical positions on a plurality of vertical plates; wherein the pin has a first end, a second end, and a middle portion; wherein the roller is located in the middle portion of the pin, and wherein the first and second ends of the pin pass through the at least two first holes and the at least two second holes respectively; wherein steel plates on both ends of the seam are pre-stamped to form inward recesses, and welding spots are provided therein.

2. The high-pressure oil pump roller tappet according to claim 1, wherein a locking block is arranged on the seam between the welding spots or on the shell opposing the seam; wherein the locking block is a sector cylinder made by stamping, which protrudes from the shell; and wherein the locking block is one of a short locking block and a long locking block.

3. The high-pressure oil pump roller tappet according to claim 1, wherein lateral planes of the shell on which the at least two first planes are located are of planar structure.

4. The high-pressure oil pump roller tappet according to claim 1, wherein a lower portion of a lateral plane on which each of the at least two first planes is located is of a cylindrical structure.

5. The high-pressure oil pump roller tappet according to claim 4, wherein the at least two first planes are stamped inwardly to form a bayonet between each of the at least two first planes and the lower portion of the cylindrical structure; and wherein two vertical plates of the holder pass through the bayonet.

6. The high-pressure oil pump roller tappet according to claim 1, wherein the holder has a baseplate; wherein the baseplate has an upper side and an under side; wherein the baseplate of the holder is one of a first baseplate with a projecting curved surface structure and a second baseplate with a planar structure.

7. The high-pressure oil pump roller tappet according to claim 6, wherein a groove is arranged on the underside of the baseplate of the holder, and wherein a boss is formed on the upper side of the baseplate of the holder accordingly.

8. The high-pressure oil pump roller tappet according to claim 1, wherein a plurality of ribs are arranged on bending parts between vertical plates and baseplates of the holder.

9. The high-pressure oil pump roller tappet according to claim 1, wherein each of the first and second ends of the pin is one of a second plane and a curved surface, and wherein a curvature of the curved surface corresponds to a curvature of the shell.

* * * * *